US011871785B2

(12) United States Patent
Liu

(10) Patent No.: US 11,871,785 B2
(45) Date of Patent: Jan. 16, 2024

(54) ATOMIZER HAVING INNER AND OUTER GLASS TUBES

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 480 days.

(21) Appl. No.: 17/131,655

(22) Filed: Dec. 22, 2020

(65) Prior Publication Data

US 2022/0061384 A1 Mar. 3, 2022

(30) Foreign Application Priority Data

Aug. 25, 2020 (CN) ..... 202010864579.1
Aug. 25, 2020 (CN) ..... 202021794114.5

(51) Int. Cl.
*A24F 40/42* (2020.01)
*A24F 40/48* (2020.01)
*A24F 40/10* (2020.01)

(52) U.S. Cl.
CPC ..... *A24F 40/42* (2020.01); *A24F 40/10* (2020.01); *A24F 40/48* (2020.01)

(58) Field of Classification Search
CPC ..... A24F 40/42; A24F 40/48; A24F 40/10; A24F 40/40
See application file for complete search history.

(56) References Cited

U.S. PATENT DOCUMENTS 10,506,827 B2 * 12/2019 Guo ..... A24F 40/05
2016/0183597 A1 * 6/2016 Li ..... H05B 1/0244 392/404
2018/0368472 A1 * 12/2018 Mishra ..... H05B 1/0297
2019/0307169 A1 * 10/2019 Yuan ..... A24F 7/02
2020/0170299 A1 * 6/2020 Yuan ..... A24F 40/485

* cited by examiner

*Primary Examiner* — Hae Moon Hyeon
(74) *Attorney, Agent, or Firm* — MATTHIAS SCHOLL P.C.; Matthias Scholl

(57) ABSTRACT

An atomizer includes an outer glass tube and an inner glass tube. The inner glass tube is disposed in the outer glass tube. The upper edge of the inner glass tube is integrated with the inner wall of the outer glass tube. The inner glass tube includes an air passage communicating with the upper opening of the outer glass tube. The space between the outer glass tube and the inner glass tube is used as an e-liquid tank and e-liquid is injected to the space via the bottom opening of the outer glass tube for atomization.

7 Claims, 3 Drawing Sheets

ATOMIZER HAVING INNER AND OUTER GLASS TUBES

CROSS-REFERENCE TO RELATED APPLICATIONS

Pursuant to 35 U.S.C. § 119 and the Paris Convention Treaty, this application claims foreign priority to Chinese Patent Application No. 202010864579.1 filed on Aug. 25, 2020, and to Chinese Patent Application No. 202021794114.5 filed on Aug. 25, 2020. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to an atomizer.

Conventionally, the heating wire of an electronic cigarette is directly immersed in the e-liquid. After a period of time, the quality of the e-liquid may be adversely affected by the heating wire.

SUMMARY

The disclosure provides an atomizer, comprising an outer glass tube and an inner glass tube; the inner glass tube is disposed in the outer glass tube; an upper edge of the inner glass tube is integrated with an inner wall of the outer glass tube; the inner glass tube comprises an air passage communicating with an upper opening of the outer glass tube; a space between the outer glass tube and the inner glass tube is used as an e-liquid tank and e-liquid is injected to the space via a bottom opening of the outer glass tube for atomization.

In a class of this embodiment, the atomizer further comprises a fixed base and a ceramic core; the ceramic core is disposed in the fixed base for atomizing the e-liquid; an upper part of the fixed base is disposed in the bottom opening of the outer glass tube, and a top opening of the fixed base is nested in a lower opening of the inner glass tube; the fixed base seals a bottom gap between the outer glass tube and the inner glass tube so that the e-liquid is stored in a sealed space between the outer glass tube and the inner glass tube.

In a class of this embodiment, the fixed base comprises an environmentally friendly food grade silica gel material and an e-liquid inlet (401).

In a class of this embodiment, the fixed base further comprises environmentally friendly plastic, rubber, and wood materials.

In a class of this embodiment, the atomizer further comprises a connection ring, a compression ring, and a base, wherein the connection ring is disposed around the bottom opening of the outer glass tube; the compression ring is fixed on the connection ring; the base is in threaded connection to the connection ring; and a lower part of the fixed base is disposed in the base.

In a class of this embodiment, the base comprises at least one air inlet.

In a class of this embodiment, the atomizer further comprises an insulation ring and an electrode, wherein the insulation ring is disposed in the base, and the electrode is disposed in the insulation ring.

In a class of this embodiment, the inner glass tube and the outer glass tube each comprise ceramics, quartz, agate, jade, or a combination thereof.

DETAILED DESCRIPTION

To further illustrate, embodiments detailing an atomizer are described below. It should be noted that the following embodiments are intended to describe and not to limit the disclosure.

Figure 1:
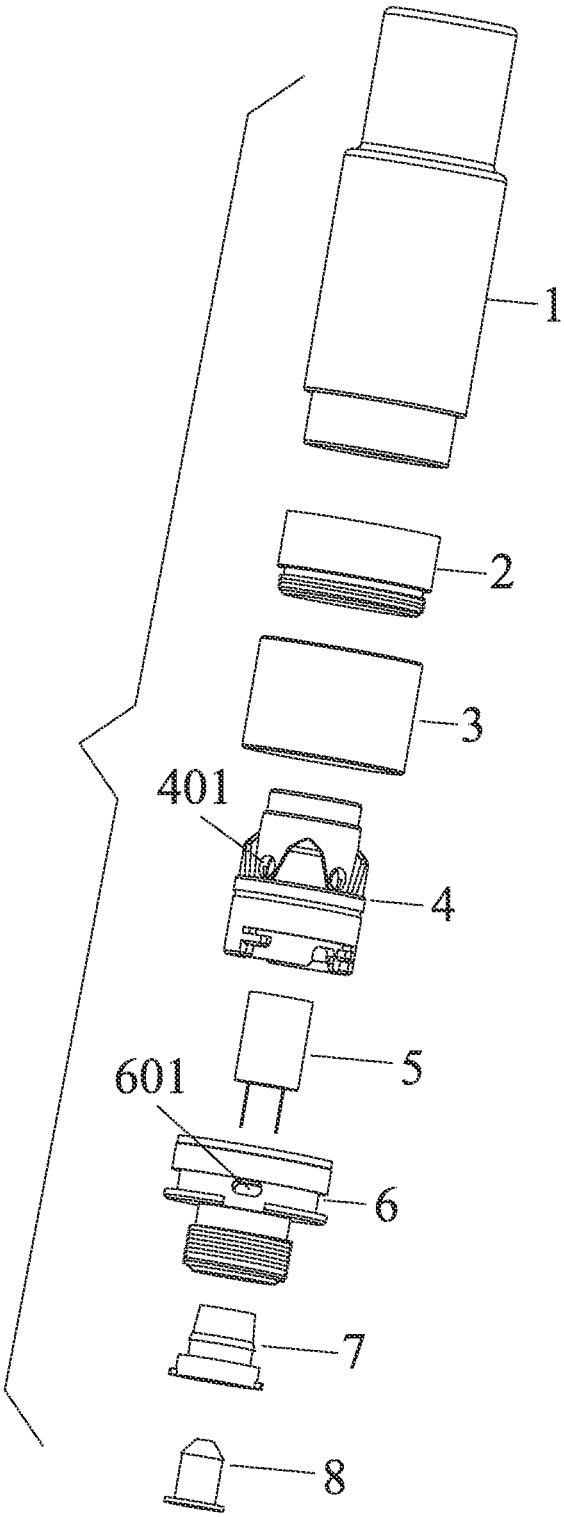
FIG. 1 is an exploded view of an atomizer in accordance with one embodiment of the disclosure.
Figure 2:
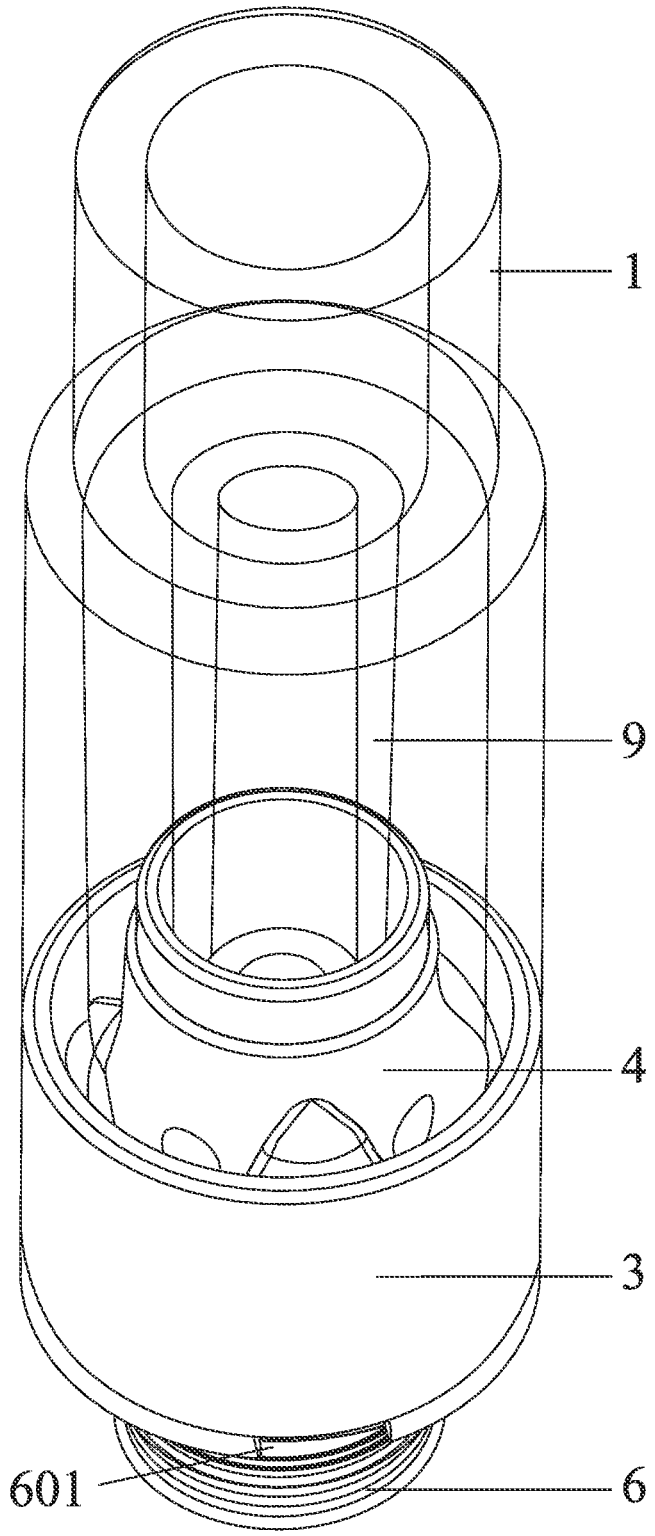
FIG. 2 is a schematic diagram of an atomizer in accordance with one embodiment of the disclosure.
Figure 3:
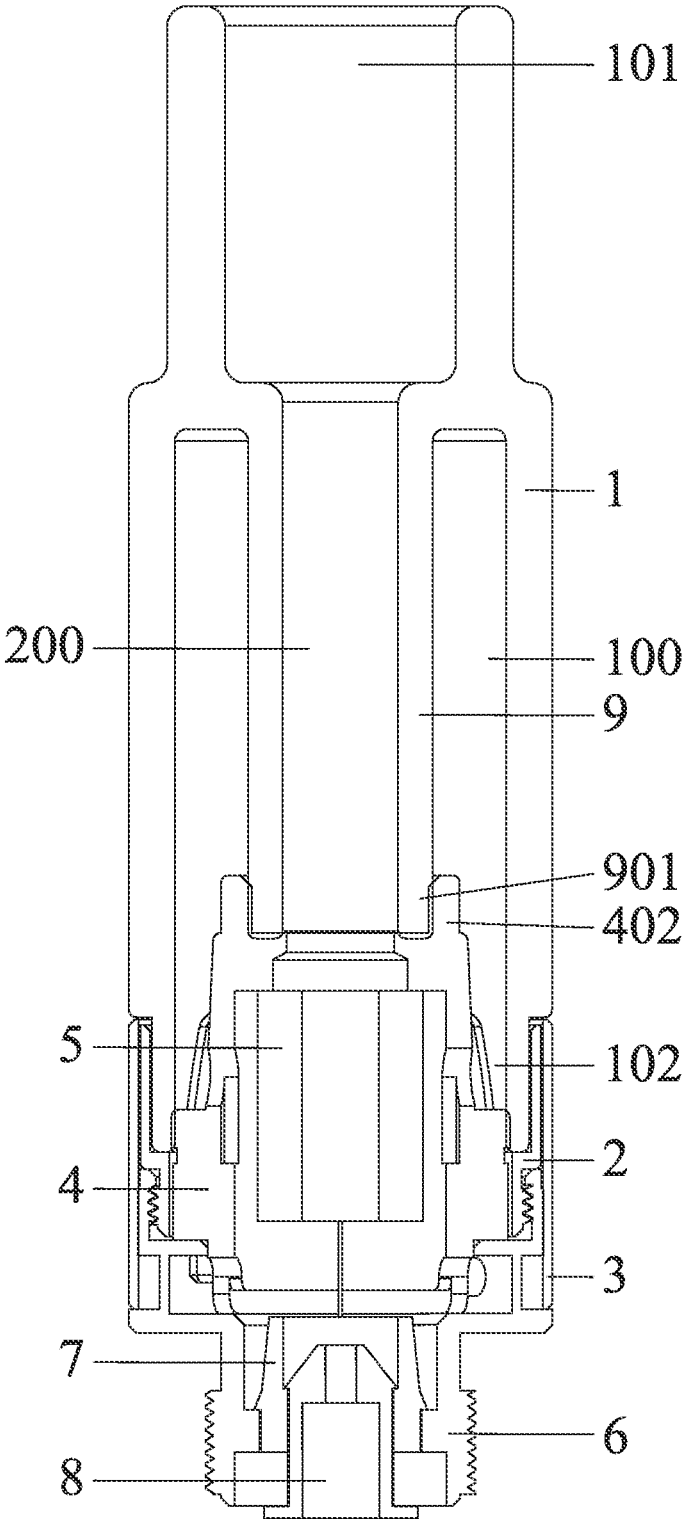
FIG. 3 is a sectional view of an atomizer in accordance with one embodiment of the disclosure.

As shown in FIGS. 1-3, the disclosure provides an atomizer comprising an outer glass tube 1, a connection ring 2, a compression ring 3, a fixed base 4, a ceramic core 5, a base 6, an insulation ring 7, an electrode 8, and an inner glass tube 9. The inner glass tube 9 is disposed in the outer glass tube 1. The upper edge of the inner glass tube 9 is integrated with the inner wall of the outer glass tube 1. The inner glass tube 9 comprises an air passage 200 communicating with an upper opening 101 of the outer glass tube 1. A space 100 between the outer glass tube 1 and the inner glass tube 9 is used as an e-liquid tank and the e-liquid is injected to the space 100 via the bottom opening 102 of the outer glass tube 1 for atomization. The connection ring 2 is disposed around the bottom opening 102 of the outer glass tube 1. The compression ring 3 is fixed on the connection ring 2. The ceramic core 5 is disposed in the fixed base 4 for atomizing e-liquid. The upper part of the fixed base 4 is disposed in the bottom opening 102 of the outer glass tube 1, and the top opening 402 of the fixed base 4 is nested in the lower opening 901 of the inner glass tube 9. The fixed base 4 seals the bottom gap between the outer glass tube 1 and the inner glass tube 9 so that the e-liquid is stored in the seal space 100 between the outer glass tube 1 and the inner glass tube 9. The base 6 is in threaded connection to the connection ring 2. The lower part of the fixed base 4 is disposed in the base 6. The insulation ring 7 is disposed in the base 6 to insulate the positive and negative pins of the ceramic core 5 and prevent short circuit. The electrode 8 is disposed in the insulation ring 7 to fix the positive and negative pins.

In certain embodiments, an airflow regulation ring is disposed on the base 6. The airflow regulation ring comprises an air inlet 601 . Rotating the airflow regulation ring with respect to the base can adjust the volume of the airflow. The ceramic core 5 comprises one or more through holes and one or more heating wires are disposed in each through hole. The resistance and the diameter of the heating wire are arbitrary. The heating wire is a metal wire or an alloy wire. The shape of the ceramic core 5 is arbitrary and optionally, a strip of cotton is wrapped around the ceramic core.

When in use, the e-liquid enters the ceramic core 5 via the through hole of the fixed base 4 and is atomized to produce vapor. The air enters the ceramic core via the air inlet 601 of the base 6 and drives the vapor to flow into the air passage 200 of the inner glass tube 9. The vapor is released out of the top opening 402 of the outer glass tube 1 for user's inhaling.

The following advantages are associated with the atomizer of the disclosure:

1. The atomizer comprises an outer glass tube and an inner glass tube disposed in the outer glass tube. The space between the outer glass tube and the inner glass tube is used as an e-liquid tank and e-liquid is stored in the space, and the inner space of the inner glass tube operates as an air passage for circulation of air and vapor.
2. The fixed base comprises an environmentally friendly food grade silica gel material for transmission and sealing of the e-liquid, which is environmentally friendly and healthy for users.
3. The material of the atomizer is glass and an environmentally friendly food grade silica gel material, which is safe for use.

It will be obvious to those skilled in the art that changes and modifications may be made, and therefore, the aim in the appended claims is to cover all such changes and modifications.

What is claimed is:

1. An automizer, comprising:

an outer glass tube;

an inner glass tube;

a fixed base; and a ceramic core; and heating wires for vaporizing e-liquid disposed inside the ceramic core;

wherein the inner glass tube is disposed in the outer glass tube; an upper edge of the inner glass tube is integrated with an inner wall of the outer glass tube; the inner glass tube comprises an air passage communicating with an upper opening of the outer glass tube; a space between the outer glass tube and the inner glass tube is used as an e-liquid tank and e-liquid is injected to the space via a bottom opening of the outer glass tube for atomization; and the ceramic core is disposed in the fixed base for atomizing the e-liquid; an upper part of the fixed base is disposed in the bottom opening of the outer glass tube, and a top opening of the fixed base is nested in a lower opening of the inner glass tube; the fixed base seals a bottom gap between the outer glass tube and the inner glass tube so that the e-liquid is stored in the space between the outer glass tube and the inner glass tube.

2. The atomizer of claim 1, wherein the fixed base comprises an environmentally friendly food grade silica gel material and an e-liquid inlet.

3. The atomizer of claim 2, wherein the fixed base further comprises environmentally friendly plastic, rubber, and wood materials.

4. The atomizer of claim 3, further comprising a connection ring, a compression ring, and a base, wherein the connection ring is disposed around the bottom opening of the outer glass tube; the compression ring is fixed on the connection ring; the base is in threaded connection to the connection ring; and a lower part of the fixed base is disposed in the base.

5. The atomizer of claim 4, wherein the base comprises at least one air inlet.

6. The atomizer of claim 5, further comprising an insulation ring and an electrode, wherein the insulation ring is disposed in the base, and the electrode is disposed in the insulation ring.

7. The atomizer of claim 1, wherein the inner glass tube and the outer glass tube each comprise ceramics, quartz, agate, jade, or a combination thereof.

* * * * *